US008153575B1

(12) United States Patent
Sjong

(10) Patent No.: US 8,153,575 B1
(45) Date of Patent: Apr. 10, 2012

(54) IMMOBILIZED ENZYME COMPOSITIONS FOR DENSIFIED CARBON DIOXIDE DRY CLEANING

(75) Inventor: Angele Sjong, Louisville, CO (US)

(73) Assignee: Empire Technology Development LLC, Wilmington, DE (US)

( * ) Notice: Subject to any disclaimer, the term of this patent is extended or adjusted under 35 U.S.C. 154(b) by 0 days.

(21) Appl. No.: 13/202,933

(22) PCT Filed: Mar. 7, 2011

(86) PCT No.: PCT/US2011/027368

§ 371 (c)(1),
(2), (4) Date: Aug. 23, 2011

(51) Int. Cl.
*C11D 3/43* (2006.01)
*C11D 3/386* (2006.01)

(52) U.S. Cl. ..... 510/300; 510/285; 510/304; 510/407

(58) Field of Classification Search ..... 510/285, 510/300, 304, 407
See application file for complete search history.

(56) References Cited

U.S. PATENT DOCUMENTS

| | | | | |
|---|---|---|---|---|
| 3,776,693 | A | 12/1973 | Smith et al. | |
| 3,933,536 | A | 1/1976 | Doser et al. | |
| 4,814,098 | A * | 3/1989 | Inada et al. | 252/62.51 R |
| 5,267,455 | A | 12/1993 | Dewees et al. | |
| 5,478,910 | A * | 12/1995 | Russell et al. | 528/274 |
| 5,486,212 | A * | 1/1996 | Mitchell et al. | 8/142 |
| 5,512,332 | A | 4/1996 | Liberti et al. | |
| 5,683,977 | A | 11/1997 | Jureller et al. | |
| 5,783,627 | A * | 7/1998 | Kao et al. | 525/54.1 |
| 5,904,737 | A | 5/1999 | Preston et al. | |
| 5,912,408 | A | 6/1999 | Trinh et al. | |
| 6,114,295 | A | 9/2000 | Murphy | |
| 6,461,387 | B1 * | 10/2002 | Jureller et al. | 8/142 |
| 6,491,730 | B1 | 12/2002 | Cauble et al. | |
| 7,732,051 | B2 | 6/2010 | Tamori et al. | |

FOREIGN PATENT DOCUMENTS

| | | |
|---|---|---|
| WO | WO-94/02597 | 2/1994 |
| WO | WO-96/23873 | 8/1996 |

OTHER PUBLICATIONS

Arvusuk, K. et al., "Activity and Stability of *Aspergillus niger* Lipase Immobilized on Rice Hull Ash in Isooctane," printed on May 26, 2011, retrieved from the internet at http://www.aseanbiotechnology.info/Abstract/23002482.pdf, 2 pp. (with English abstract).

Chiralvision webpage, "Carrier-bound enzymes as tool for chiral compound production," *SP2 Magazine: Process Development & Scale-up—Chiral Technologies*, Apr. 2007, printed on May 26, 2011, retrieved from the internet at http://www.chiralvision.com/pdf/carrier-bound_enzymes_chiralvision.pdf, 2 pp.

Dizge, N. et al., "Biodiesel production from canola oil by using lipase immobilized onto hydrophobic microporous styrene-divinylbenzene copolymer," *Biochemical Engineering Journal*, 2009, vol. 44, pp. 220-225.

Dizge, N. et al., "Biodiesel production from sunflower, soybean, and waste cooking oils by transesterification using lipase immobilized onto a novel microporous polymer," *Bioresource Technology*, 2009, vol. 100, pp. 1983-1991.

Habulin, M. et al., "Enzymatic Hydrolysis of Sunflower Oil in SC $CO_2$," Faculty of Chemistry and Chemical Engineering, 2000, printed on May 26, 2011, retrieved from the internet at http://www.isasf.net/fileadmin/files/Docs/Versailles/Papers/Rbl.pdf, 6 pp.

Harper, N. et al., "Enhancement of Enzyme Activity in Supercritical Carbon Dioxide via Changes in Acid-Base Conditions," *Biotechnology Progress*, 2002, vol. 18, No. 6, pp. 1451-1454.

International Search Report and Written Opinion for Intl. Pat. Appln. No. PCT/US2011/027368, mailed Apr. 14, 2011, 9 pp.

Jung, S. et al., "Recyclable chaperone-conjugated magnetic beads for in vitro refolding of *Burkholderia cepacia* lipase," *Biotechnol. Lett.*, 2009, vol. 31, pp. 107-111.

Kao, F-J. et al., "Supercritical Fluids as Substitutes for Dry Cleaning Solvents: Evaluation of Enzyme Activity for Stain Removal," *Technical Report No. 28*, 1995, The Massachusetts Toxics Use Reduction Institute, 16 pp.

Silva, J. E. S. et al., "Evaluation of the catalytic activity of lipases immobilized on chrysotile for esterification," *An Acad Bras Cienc*, 2003, vol. 75, No. 2, pp. 157-162.

Svendsen, A., "Lipase protein engineering," *Biochimica et Biophysica Acta*, 2000, vol. 1543, pp. 223-238.

Tan, T. et al., "Biodiesel production with immobilized lipase: A review," *Biotechnology Advances*, 2010, vol. 28, pp. 628-634.

Wikipedia webpage, "Immobilized enzyme," printed on May 26, 2011, retrieved from the internet: URL:<http://en.wikipedia.org/wiki/Immobilized_enzyme>, 2 pp.

Zaks, A. et al., "Enzyme-catalyzed processes in organic solvents," *Proc. Natl. Acad. Sci. USA*, May 1985, vol. 82, pp. 3192-3196.

* cited by examiner

*Primary Examiner* — Charles Boyer
(74) *Attorney, Agent, or Firm* — Foley & Lardner LLP

(57) ABSTRACT

The present technology relates to compositions and processes for improved dry cleaning using densified carbon dioxide. The methods utilize a composition comprising densified carbon dioxide and a plurality of magnetic particles comprising a lipase wherein the lipase is immobilized on the surface of one or more of the plurality of magnetic particles.

21 Claims, No Drawings

IMMOBILIZED ENZYME COMPOSITIONS FOR DENSIFIED CARBON DIOXIDE DRY CLEANING

CROSS-REFERENCE TO RELATED APPLICATIONS

This application is a national stage application of International Application Serial No. PCT/US2011/027368, filed on Mar. 7, 2011, the entire contents of which is hereby incorporated by reference as if fully set forth herein.

BACKGROUND

Densified carbon dioxide, including supercritical carbon dioxide ($scCO_2$), is an environmentally attractive, non-toxic solvent for dry cleaning since it results in no waste and does not damage equipment or clothing at normal operating temperatures. However, densified carbon dioxide does not match the solvent capabilities of common dry cleaning liquids, resulting in longer dwell times and slowed processing of fabrics to be cleaned.

SUMMARY

The present technology provides improved cleaning compositions, systems and methods for dry cleaning with densified carbon dioxide. The technology employs cross-linked enzymes immobilized on magnetic particles to facilitate the removal of fats and grease from fabric. Such cross-linked immobilized enzymes are readily recoverable after each cleaning cycle using a magnetic filter and retain their effectiveness longer than enzymes which have not been immobilized.

In one aspect, the present technology provides a composition including densified carbon dioxide and a plurality of magnetic particles. The particles include a lipase wherein the lipase is immobilized on the surface of one or more of the plurality of magnetic particles. In some embodiments, the densified carbon dioxide is supercritical carbon dioxide. The lipase used may be any suitable lipase isolated or derived from bacteria, fungus or yeast. Thus, the lipase may be produced recombinantly by methods well known in the art. In an illustrative embodiment, the lipase is isolated or derived from *Aspergillus, Candida, Thermomyces, Bacillus, Humicola, Chromobacter, Pseudomonas, Ralstonia, Rhizomucor, Rhizopus*, or a combination of two or more thereof. For example, the lipase may be isolated or derived from *Aspergillus niger, Candida antarctica, Candida rugosa, Thermomyces lanuginosus, Bacillus* sp., *Humicola lanuginosa, Chromobacter viscosum, Pseudomonas mendocina, Ralstonia pickettii, Rhizomucor miehel, Humicola* sp., and *Rhizopus niveus*, or a combination of two or more thereof. In some embodiments, the compositions include magnetic particles comprising one or more enzymes selected from the group consisting of proteases, cellulases, amylases and oxidases.

The surface of the magnetic particles may include a polymer coating. In some embodiments, the polymer is selected from polyacrylate, polystyrene, polyethylenimine, polysulfone, poly(vinyl alcohol), polyethylene glycol, polyethylene oxide and copolymers of any one thereof. In an illustrative embodiment, the lipase is tethered to the polymer coating through a polyethylene glycol linker. The magnetic particles may comprise ferritic stainless steel, superparamagnetic iron oxide, neodymium alloy, Alnico alloy, Ticonal alloy, Ni, Co, Sm—Co alloy, or a mixture of any two or more thereof. In some embodiments the magnetic particle has a diameter ranging from about 0.1 mm to about 2 mm.

Compositions of the present technology may further include one or more surfactants, modifiers (including but not limited to cosolvents), and organic peroxyacids. In some embodiments, the compositions of the present technology include a surfactant, selected from siloxanes, perhalogenated aliphatics, polypropylene glycols, perhaloether aliphatics, and fluorinated acrylates. In other embodiments, the composition includes an organic peroxyacid selected from aliphatic peroxyacids of formula I and aromatic peroxyacids of formula II:

I

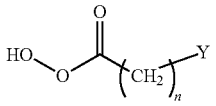

II

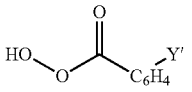

wherein, Y is H, Cl, COOH or COOOH; Y' is H, $C_1$, $C_{13}$ alkyl, $C_{1-3}$ haloalkyl, COOH or COOOH; and n is an integer from 1 to 20. In still other embodiments, the compositions include a modifier selected from the group consisting of water, acetone, glycols, acetonitrile, $C_{1-10}$ alcohols, and $C_{5-15}$ hydrocarbons.

In another aspect, the present technology provides methods of cleaning articles of fabric. The methods include contacting an article of fabric with any of the compositions disclosed herein in an amount effective for cleaning the fabric. In some embodiments of the methods, the composition is maintained at a temperature of about 30° C. to about 50° C. The methods may further include separating the magnetic particles from the cleaned article of fabric. Such separation may be carried out using a magnetic field.

In another aspect, the present technology provides a dry cleaning system that includes an apparatus for cleaning using densified carbon dioxide, densified carbon dioxide and a plurality of magnetic particles including a lipase wherein the lipase is immobilized on the surface of one or more of the plurality of magnetic particles. In some embodiments, the dry cleaning system further includes a magnetic field source for separating magnetic particles from densified carbon dioxide.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

The illustrative embodiments described in the detailed description and claims are not meant to be limiting. Other embodiments may be utilized, and other changes may be made, without departing from the spirit or scope of the subject matter presented here.

The present technology provides dry cleaning compositions for use in densified carbon dioxide dry cleaning. The compositions include densified carbon dioxide and magnetic particles in which lipase is immobilized on the surfaces of the magnetic particles. "Densified carbon dioxide" refers to gaseous carbon dioxide which has been placed under sufficient pressure and temperature to exist in the liquid or supercritical phase. Supercritical carbon dioxide is a particularly useful form of densified carbon dioxide in the present compositions. "Supercritical carbon dioxide" refers to carbon dioxide which is at or above the critical temperature of about 31.1° C. and the critical pressure of about 7.39 MPa, and which cannot be condensed into the liquid phase despite the addition of further pressure. Thus supercritical carbon dioxide expands to fill a container like a gas, but still has fluid-like properties that, to a certain extent, may be tuned by controlling the temperature and pressure.

Lipases that may be used in the present compositions include any of microbial origin that are suitable for use in detergent formulations to enhance the removal of fat or oil-containing stains resulting from, e.g., frying fats and oils, salad dressing, human sebum and cosmetics such as lipstick. A lipase is an enzyme that catalyzes the hydrolysis of ester bonds in water-insoluble lipid substrates. Useful lipases therefore include but are not limited to lipase B and alkaline lipase among others. Lipases may be isolated or derived from any suitable microbes, including fungi, bacteria and yeast. In illustrative embodiments the lipase is isolated or derived from *Aspergillus, Candida, Thermomyces, Bacillus, Humicola, Chromobacter, Pseudomonas, Ralstonia, Rhizomucor*, and *Rhizopus*. For example, the lipase may be isolated or derived from *Aspergillus niger, Candida antarctica, Candida rugosa, Thermomyces lanuginosus, Bacillus* sp., *Humicola lanuginosa, Chromobacter viscosum, Pseudomonas mendocina, Ralstonia pickettii, Rhizomucor miehel, Humicola* sp., and *Rhizopus niveus*. A number of commercially available lipases may be used such as LIPOLASE (Novo Nordisk), a lipase derived from *Humicola lanuginose*, but recombinantly produced in *Aspergillus*.

Magnetic particles, including particles of various sizes, comprise a magnetic substance, which substance is either a magnet, i.e. having a "magnetic memory" or a substance which is not a magnet but is attracted to magnets, e.g., a ferromagnetic material. The magnetic particles may consist solely or essentially of the magnetic substance. Alternatively, the magnetic particles may be composite particles comprising the magnetic substance and other non-magnetic substances such as agar, agarose, non-magnetic metal, glass, nitrocellulose, and the like. The composite particle may either consist of a core or be made of the magnetic substance and a shell made of the non-magnetic substance or may comprise several sub-particles made of the magnetic substance embedded in the non-magnetic substance. For example, the magnetic particles may be injection molded magnets that are composites of a resin and a magnetic powder. The magnetic particles can also be ceramic magnets such as, e.g., sintered composites of iron oxide and barium/strontium carbonate. In illustrative embodiments, the magnetic substance in the particles is ferromagnetic, for example, the particles are made of ferritic stainless steel or superparamagnetic iron oxide. Such particles are capable of responding well to relatively weak magnetic fields, but have essentially no magnetic memory, that is once the magnetic field is removed they do not maintain magnetic attraction forces. In other illustrative embodiments, the magnetic substance can be a neodymium alloy (e.g., NdFeB or $Nd_2Fe_{14}B$), an Alnico iron alloy (i.e., alloys of Al, Ni, Co, Fe), a Ticonal alloy (i.e., alloys of Ti, Co, Ni, Al), Ni, Co, Sm—Co alloy, or a mixture of any two or more thereof.

In some embodiments, the magnetic particle is coated with a polymer coating. Representative polymers include polyacrylate, polystyrene, polyethylenimine, polysulfone, poly (vinyl alcohol), polyethylene glycol, polyethylene oxide and copolymers of any one thereof. The magnetic particles may be coated with polymer according to any method known in the art (see, e.g., U.S. Pat. Nos. 3,933,536; 5,512,332; and 7,732,051). For example, emulsion polymerization of styrene and acrylic acid may be carried out in the presence of a suspension of magnetic particles (see, e.g., *Biotechnol. Lett.* (2009) 31:107-11). The lipase may then be coupled using carbodiimide chemistry as in Example 1 below. Alternatively, magnetic material (e.g., iron oxide) may be precipitated into the pores of a polymeric bead and optionally sealed in by, e.g., glycidyl ether. Such magnetic beads suitable for coupling to lipases are commercially available as DYNABEADS from the Dynal division of Life Technologies Corporation (Oslo, Norway).

The magnetic particles may generally be any size and shape. The magnetic particles will typically be uniform in size, although they may alternatively have a distribution of sizes. The magnetic particles may be spherical or have other regular or irregular shapes. The magnetic particles may be readily separated from the clothing being cleaned and the densified carbon dioxide. In illustrative embodiments, the magnetic particles range from about 0.1 mm to about 2 mm in diameter. Specific examples of sizes include about 0.1 mm, about 0.2 mm, about 0.3 mm, about 0.4 mm, about 0.5 mm, about 0.6 mm, about 0.7 mm, about 0.8 mm, about 0.9 mm, about 1.0 mm, about 1.1 mm, about 1.2 mm, about 1.3 mm, about 1.4 mm, about 1.5 mm, about 1.6 mm, about 1.7 mm, about 1.8 mm, about 1.9 mm, about 2.0 mm, and ranges between any two of these values. In some embodiments, the magnetic particles range from any of about 0.1 mm, about 0.2 mm, about 0.3 mm, or about 0.5 mm to any of about 1.8 mm, about 1.6 mm, about 1.4 mm, about 1.2 mm, or about 1.0 mm in diameter. The amount of magnetic particles in the present compositions may range from about 0.01 wt % to about 5 wt % of the total weight of the composition. Examples of the amount of magnetic particles in the present compositions include but are not limited to about 0.05 wt %, about 0.1 wt %, about 0.2 wt %, about 0.4 wt %, about 0.5 wt %, about 0.6 wt %, about 0.8 wt %, about 1.0 wt %, about 1.5 wt %, about 2.0 wt %, about 2.5 wt %, about 3.0 wt %, about 3.5 wt %, about 4.0 wt %, about 4.5 wt %, and ranges including and between any two of these values.

The lipase may be tethered to the magnetic particles in a variety of ways. For example, the lipase may simply be absorbed onto a polymer coating on the magnetic particle such as acrylic resin or polypropylene. The lipase may also be entrapped on or within a matrix of polymer. Alternatively, the lipase may be directly linked to the polymer coating through suitable functional groups on the polymer such as amine, epoxide, hydroxyl, and carboxylic acid groups. Such groups may be used to form imine, amide or ester linkages with the appropriate groups on the lipase using known conjugation methods such as glutaraldehyde or carbodiimide coupling chemistries (see, e.g., Tan, T., et al. *Biotechnology Advances* (2010), 28, 628-34; Dizge, N., et al. *Biochem. Eng.* (2009) 44: 220-25; Dizge, N., et al. *Bioresour. Technol.* (2009) 100: 1983-91). In some embodiments, the lipase is tethered to the magnetic particle through a linking group such as polyethylene glycol (PEG), connected via, e.g., ester or urethane linkages with the polymer and the lipase. Suitable polyethylene glycols include those having from 2 to about 100 ethylene glycol units. In some embodiments the polyethylene glycol linkers have from about 2 to about 20 ethylene glycol units. Conjugates employing linkers may be formed using the same methods noted above, e.g., esterification of the hydroxyl end groups of the PEG with carboxyl groups.

In some embodiments of the present compositions, the magnetic particles may include one or more additional laundry enzymes. Using the same techniques as described above, the additional enzymes may be immobilized on the surface of the same magnetic particles that include the lipase or different magnetic particles. Other laundry enzymes that may be used in the present methods include, but not limited to, proteases, cellulases, amylases and oxidases. Cellulases are enzymes capable of hydrolyzing cellulose. Cellulases useful in the present methods include, e.g. that produced by *Humicola insolens*, particularly DSM 1800, e.g. 50 Kda and –43 kD [Carezyme®] and the EGIII cellulases from *Trichoderma longibrachiatum*. Proteases are enzymes capable of hydrolyzing amide bonds in peptides and proteins. Proteases useful in the present methods include the many species known to be adapted for use in detergent compositions, e.g., subtilisin. Commercial protease preparations that may be used in the present methods include Alcalase®, Esperase® and Savinase® sold by Novo Industries, Denmark, and Maxatase®, Maxacal®, Purafect®, and Properase® sold by Genecor International. Amylases are enzymes capable of hydrolyzing starch to simpler sugars. Amylases (a and/or (3) that may be used in the present methods are described in WO 94/02597 and WO 96/23873. Commercial examples include Purafect Ox Am® [Genencor] and Termamyl®, Natalase®, Ban®, Fungamyl® and Duramyl® [all ex Novozymes]. Oxidases are enzymes that oxidize a substrate with oxygen; e.g., laccase can oxidize phenols. Examples of laccases that may be used in the present methods include those from *Coprinus cinereus, Polyporus pinsitus* (I) and (II), *Phlebia radiata, Rhizoctonia solani* (I), (II), (III), and (IV), *Scytalidium thermophilum*, and *Myceliophthora thermophila.*

Compositions of the present technology may further include one or more surfactants, modifiers, and organic peroxyacids. In some embodiments, the compositions of the present technology include a surfactant or modifier selected from siloxanes, perhalogenated aliphatics, polypropylene glycols, perhaloether aliphatics, and fluorinated acrylates. Analogous the hydrophobic and hydrophilic groups of aqueous surfactants, the present surfactants may have a combination of densified carbon dioxide-philic functional groups and densified carbon dioxide-phobic functional groups. The term "densified carbon dioxide-philic" in reference to surfactants means that a functional group in the surfactant is soluble in carbon dioxide at pressures of 500-10,000 psi and temperatures of 0°-100° C. to greater than 10 weight percent. Such functional groups include C1-50 halocarbons, polysiloxanes and branched polyalkylene oxides. The term "densified carbon dioxide-phobic" in reference to surfactants means that a functional group in the surfactant will have a solubility in carbon dioxide at pressures of 500-10,000 psi and temperatures of 0°-100° C. of less than 10 weight percent. The functional groups in such surfactants include carboxylic acids, phosphate esters, hydroxys, C1-30 alkyls or alkenyls, polyalkylene oxides, branched polyalkylene oxides, carboxylates, C1-30 alkyl sulfonates, phosphates, glycerates, carbohydrates, nitrates, substituted or unsubstituted aryls and sulfates. The resulting compound may form reversed micelles with the $CO_2$-philic functional groups extending into a continuous phase and the $CO_2$-phobic functional groups directed toward the center of the micelle.

Thus, siloxanes, perhalogenated aliphatics, polypropylene glycols, perhaloether aliphatics, and fluorinated acrylates useful in the present processes include but are not limited to those described in U.S. Pat. Nos. 5,683,977, 6,114,295, and the like. Commercially available, non-limiting examples of such surfactants include ZONYL and CAPSTONE (fluorosurfactants from DUPONT), PLURONIC (poloxamers by BASF), and KRYTOX (perfluoroethers from DUPONT). Traditional laundry surfactants may also be used if a sufficient amount of co-solvent is used (see, e.g., U.S. Pat. No. 6,491,730). Depending on the application, the surfactant may be present in an amount of from about 0.001 wt % to about 10 wt %, such as from about 0.01 wt % to about 5 wt %. Specific examples of surfactant amounts include 0.001 wt %, 0.01 wt %, 0.1 wt %, 0.5 wt %, 1 wt %, 2 wt %, 5 wt %, 7 wt % and 10 wt %, and ranges between any two of these values.

In some embodiments, a modifier (including cosolvents) such as water, or a useful organic solvent may be added to the present compositions. Illustrative amounts of modifier range from 0.0% to about 10% by volume, e.g, 0.0% v/v to about 5% v/v, or 0.0% v/v to about 3% v/v. Non-limiting examples of cosolvents as modifiers include water, acetone, glycols, acetonitrile, $C_{1-10}$ alcohols (e.g., methanol, ethanol), and $C_{5-15}$ hydrocarbons (e.g., hexane). However larger amounts may also be used, e.g., 10%, 15%, 20%, 30%, 40% or 50% by volume, and ranges between any two of these values.

Organic peracids which are stable in storage and which dissolve in densified carbon dioxide are effective at bleaching stains in the present compositions. The selected organic peracid should be soluble in carbon dioxide to greater than 0.001 wt. % at pressures of 500-10,000 psi and temperatures of 0°-100° C. The peracid compound may be present in an amount of about 0.01 wt % to about 5 wt %, such as about 0.1 wt % to about 3 wt %. Thus, the composition may include an organic peroxyacid selected from aliphatic peroxyacids of formula I and aromatic peroxyacids of formula II:

I

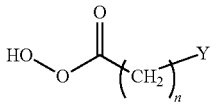

II

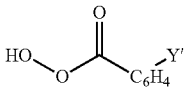

wherein, Y is H, Cl, COOH or COOOH; Y' is H, $C_1$, $C_{1-3}$ alkyl, $C_{1-3}$ haloalkyl, COOH or COOOH; and n is an integer from 1 to 20. Specific examples of organic peracids include peroxyacetic acid ($CH_3CO_3H$) and meta-chloroperoxybenzoic acid (3-$C_1$-$C_6H_4CO_3H$).

In another aspect, the present technology provides methods of cleaning articles of fabric. The methods include exposing an article of fabric to any of the compositions disclosed herein in an amount effective to produce a cleaned article of fabric. The exposure time of the article of fabric to the composition may vary, e.g., from about 1 to about 120 minutes, or from about 10 to about 60 minutes. Specific examples of exposure times include about 1 minute, about 2 minutes, about 5 minutes, about 10 minutes, about 20 minutes, about 30 minutes, about 45 minutes, about 60 minutes, about 90 minutes, about 120 minutes and ranges between any two of these values.

During exposure of the fabric to the composition, the composition is maintained at a suitable temperature and pressure for cleaning with densified carbon dioxide. Thus, in some embodiments of the present methods, the temperature of the composition ranges from about 0° C. to about 100° C., from about 20° C. to about 60° C. or from about 30° C. to about 50° C. Specific examples of temperatures of the composition include about 0° C., about 10° C., about 20° C., about 30° C., about 40° C., about 50° C., about 60° C., about 70° C., about 80° C., about 90° C., about 100° C. and ranges between any two of these values. In some embodiments of the present methods, the pressure of the composition is maintained at about 800 psi (5.52 MPa) to about 5,000 psi (34.47 MPa), or at about 1000 psi (6.89 MPa) to 2,500 psi (17.24 MPa). Specific examples of pressures that may be used include about 800 psi (5.52 MPa), about 900 psi (6.21 MPa), about 1,000 psi (6.89 MPa), about 1,200 psi (8.27 MPa), about 1,500 psi (10.34 MPa), about 2,000 psi (13.79 MPa), about 2,500 psi (17.24 MPa), about 3,000 psi (20.68 MPa), about 4,000 psi (27.58 MPa), about 5,000 psi (34.47 MPa), or ranges between any two of these values.

The present methods may include additional steps such as, but not limited to, agitating the article of fabric and the composition, separating the densified carbon dioxide from the cleaned article of fabric; separating the magnetic particles from the cleaned article of fabric and/or the densified carbon dioxide. Such separations may be carried out using a magnetic field. In some embodiments, the composition is first separated from the cleaned articles of fabric as, e.g., a liquid, and the magnetic particles are subsequently removed from the used composition magnetically, e.g., by magnetic filtration. The magnetic particles may be rinsed and reused in another cleaning composition. The remainder of the composition may be processed to remove dirt and other residue and then recycled for further use with the recycled magnetic particles.

The article of fabric may be cleaned alone, or in combination with other articles of fabrics in a load. The article of fabric may generally be any article of fabric that is to be cleaned. The articles of fabric may be safe to clean with water or unsafe to clean with water ("dry clean only"). Specific examples of articles of fabric include shirts, pants, skirts, socks, leggings, undergarments, hats, gloves, dresses, sheets, curtains, pillows, blankets, comforters, duvets, jackets, suits, and so on.

In another aspect, the present technology provides a dry cleaning system that includes an apparatus for cleaning using densified carbon dioxide, a densified carbon dioxide delivery system, and a plurality of magnetic particles including a lipase wherein the lipase is immobilized on the surface of one or more of the plurality of magnetic particles. The apparatus can include a chamber configured to contain the densified carbon dioxide, the plurality of magnetic particles, and articles of fabric to be cleaned. Optionally, the chamber allows for agitation of the articles of fabric and composition during cleaning. The densified carbon dioxide delivery system can be configured to deliver densified carbon dioxide into the chamber. The densified carbon dioxide delivery system can hold densified carbon dioxide, or can be configured to receive non-densified carbon dioxide and to convert it into densified carbon dioxide as needed. In some embodiments, the dry cleaning system further includes a magnetic field source for separating magnetic particles from densified carbon dioxide. Such a source may be readily added to apparatuses known in the art for densified carbon dioxide cleaning, e.g., U.S. Pat. Nos. 5,267,455 or 5,904,737. The system can include at least one outlet configured to remove carbon dioxide from the chamber. The carbon dioxide can be removed from the chamber either as densified carbon dioxide or as non-densified carbon dioxide. Carbon dioxide removed from the chamber can be released into the atmosphere or can be retained for recycling or reuse. The system can include at least one control unit programmed to perform any of the above described methods of cleaning an article of fabric. The system can include at least one sensor unit that measures the degree to which the article of fabric has been cleaned.

EXAMPLES

The present technology is further illustrated by the following examples, which should not be construed as limiting in any way.

Example 1

Preparation of Lipase Conjugated to Magnetic Particles

Ten grams of iron oxide magnetic particles are suspended in 500 mL water containing 0.2 g sodium dodecyl sulfate (SDS) with stirring. Potassium persulfate (0.2 g) is added and the suspension is stirred for 30 or more minutes under nitrogen. The suspension is heated to 75° C. for 30 or more minutes with stirring. Ten mL of styrene (wash with 0.1M NaOH and water before use), 1 g SDS, and 0.8 g hexadecane are added to 800 mL water. An emulsion is created with vigorous stirring. The styrene emulsion is slowly added to the suspension of magnetic particles. Ten mL acrylic acid is added to the styrene/magnetic particle mixture and stirred at 75° C. for 20 hours. The polymer coated magnetic particles are washed once with 100 mL 0.1% SDS and 3×100 mL water. A yield of about 10-13 g of polymer coated magnetic particles (beads) is expected.

The prepared beads (5 g) are suspended in 5 mL MES buffer (0.1 M, pH 5.0). After addition of 5 g 1-ethyl-3-(3-dimethylaminopropyl) carbodiimide, (optionally in the presence of 1-hydroxybenzotriazole (1 equivalent versus carbodiimide)), the suspension is stirred for 20 minutes or more at room temperature. The beads are separated and are washed 3×50 mL PBS. The beads are resuspended in 10 mL PBS and 10 mL of lipase solution (*Aspergillus niger,* 4-5 mg/mL) is added. The mixture is incubated overnight at 4° C. The conjugated beads are washed 3×10 mL PBS. The amount of bound lipase may be determined by the difference in absorbance of the supernatant at 280 nm, before and after incubation.

Example 2

Assembly of Cleaning System

A "Cool Clean" carbon dioxide dry cleaning machine is purchased from Cool Clean Technologies, Inc. (Eagan, Minn.), and is modified by adding an electromagnet capture system near the liquid carbon dioxide outlet valve but outside of the cleaning chamber. An access port is added to allow recovery of magnetic particles bound by the electromagnet.

Example 3

Cleaning of Soiled Garments

A 10 kg mixed load of household garments (including shirts, pants, and dresses) is loaded into the modified machine from Example 2. Ten grams of the magnetic particles from Example 1 are added to the cleaning chamber. The machine delivers liquid carbon dioxide to the chamber, and is operated for 30 minutes at 30° C. with tumbling of the garments. After cleaning, the electromagnet is activated. The liquid carbon dioxide and magnetic particles are removed through the outlet valve, passing the electromagnet where the particles are retained. Clean garments are removed from the cleaning chamber.

Example 4

Cleaning of Soiled Beddings

A 15 kg load of sheets, blankets, duvets, and pillowcases is loaded into the modified machine from Example 2. Ten grams of the magnetic particles from Example 1 are added to the cleaning chamber. Ten grams of peroxyacetic acid are added to the cleaning chamber. The machine delivers liquid carbon dioxide to the chamber, and is operated for 45 minutes at 30° C. with tumbling of the beddings. After cleaning, the electromagnet is activated. The liquid carbon dioxide and magnetic particles are removed through the outlet valve, passing the electromagnet where the particles are retained. Clean beddings are removed from the cleaning chamber.

Example 5

Cleaning of Greased Clothing

A 5 kg load of heavily greased work clothing obtained from an automotive repair shop is loaded into the modified machine from Example 2. Ten grams of the magnetic particles from Example 1 are added to the cleaning chamber. Liquid hexane is added to the cleaning chamber at 5% v/v. The machine delivers liquid carbon dioxide to the chamber, and is operated for 60 minutes at 40° C. with tumbling of the clothing. After cleaning, the electromagnet is activated. The liquid carbon dioxide and magnetic particles are removed through the outlet valve, passing the electromagnet where the particles are retained. Clean clothings are removed from the cleaning chamber.

EQUIVALENTS

The present disclosure is not to be limited in terms of the particular embodiments described in this application. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A composition comprising:

densified carbon dioxide; and a plurality of magnetic particles comprising a lipase wherein the lipase is immobilized on the surface of one or more of the plurality of magnetic particles.

2. The composition of claim 1 wherein the densified carbon dioxide is supercritical carbon dioxide.

3. The composition of claim 1 wherein the lipase is isolated or derived from *Aspergillus, Candida, Thermomyces, Bacillus, Humicola, Chromobacter, Pseudomonas, Ralstonia, Rhizomucor, Rhizopus*, or a combination of two or more thereof.

4. The composition of claim 1 wherein the lipase is isolated or derived from *Aspergillus niger, Candida antarctica, Candida rugosa, Thermomyces lanuginosus, Bacillus* sp., *Humicola lanuginosa, Chromobacter viscosum, Pseudomonas mendocina, Ralstonia pickettii, Rhizomucor miehel, Humicola* sp., and *Rhizopus niveus*, or a combination of two or more thereof.

5. The composition of claim 1 further comprising magnetic particles comprising one or more enzymes selected from the group consisting of proteases, cellulases, amylases and oxidases.

6. The composition of claim 1 wherein the surface of the magnetic particle comprises a polymer coating.

7. The composition of claim 6 wherein the polymer is selected from the group consisting of polyacrylate, polystyrene, polyethylenimine, polysulfone, poly(vinyl alcohol), poly(ethylene glycol), poly(ethylene oxide) and copolymers of any one thereof.

8. The composition of claim 6 wherein the lipase is tethered to the polymer coating through a polyethylene glycol linker.

9. The composition of claim 1 wherein the magnetic particles are paramagnetic or superparamagnetic.

10. The composition of claim 1 wherein the magnetic particles comprise ferritic stainless steel, superparamagnetic iron oxide, neodymium alloy, Alnico alloy, Ticonal alloy, Ni, Co, Sm—Co alloy, or a mixture of any two or more thereof.

11. The composition of claim 1 wherein the magnetic particles have a diameter of about 0.1 mm to about 2 mm.

12. The composition of claim 1 further comprising one or more surfactants, modifiers, or organic peroxyacids.

13. The composition of claim 1 further comprising one or more siloxanes, perhalogenated aliphatics, polypropylene glycols, perhaloether aliphatics, alcohols or fluorinated acrylates.

14. The composition of claim 1 further comprising at least one organic peroxyacid selected from the group consisting of aliphatic peroxyacids of formula I and aromatic peroxyacids of formula II:

I

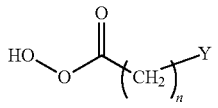

II

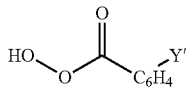

wherein,

Y is H, Cl, COOH or COOOH;

Y' is H, $C_1$, $C_{13}$ alkyl, $C_{1-3}$ haloalkyl, COOH or COOOH; and n is an integer from 1 to 20.

15. The composition of claim 1 further comprising at least one modifier selected from the group consisting of water, acetone, glycols, acetonitrile, $C_{1-10}$ alcohols, and $C_{5-15}$ hydrocarbons.

16. A method of cleaning an article of fabric, the method comprising:

contacting an article of fabric with the composition of claim 1 in an amount effective to produce a cleaned article of fabric.

17. The method of claim 16 wherein the composition is maintained at a temperature of about 30° C. to about 50° C.

18. The method of claim 16 further comprising separating the magnetic particles from the cleaned article of fabric.

19. The method of claim 18 wherein the separating step comprises exposing the magnetic particles to a magnetic field.

20. A dry cleaning system comprising:

an apparatus for cleaning using densified carbon dioxide, densified carbon dioxide and a plurality of magnetic particles comprising a lipase wherein the lipase is immobilized on the surface of one or more of the plurality of magnetic particles.

21. The dry cleaning system of claim 20 further comprising a magnetic field source.

* * * * *

UNITED STATES PATENT AND TRADEMARK OFFICE

CERTIFICATE OF CORRECTION

PATENT NO. : 8,153,575 B1
APPLICATION NO. : 13/202933
DATED : April 10, 2012
INVENTOR(S) : Sjong It is certified that error appears in the above-identified patent and that said Letters Patent is hereby corrected as shown below:

In Column 2, Line 26, delete "$C_1$, $C_{13}$" and insert -- Cl, $C_{1-3}$ --, therefor.

In Column 5, Line 20, delete "(a and/or (3)" and insert -- (α and/or β) --, therefor.

In Column 6, Line 24, delete "wt. %" and insert -- wt % --, therefor.

In Column 6, Line 42, delete "$C_1$," and insert -- Cl, --, therefor.

In Column 6, Line 46, delete "(3-$C_1$" and insert -- (3-Cl --, therefor.

In Column 11, Line 15, in Claim 14, delete "$C_1$, $C_{13}$" and insert -- Cl, $C_{1-3}$ --, therefor.

In Column 12, Lines 14-15, in Claim 20, delete "dioxide, densified carbon dioxide and" and insert -- dioxide, and --, therefor.

Signed and Sealed this
Twenty-sixth Day of June, 2012

David J. Kappos

David J. Kappos
*Director of the United States Patent and Trademark Office*